US005239585A

United States Patent [19]

Restle

[11] Patent Number: 5,239,585

[45] Date of Patent: Aug. 24, 1993

[54] DEVICES, SYSTEMS, AND METHODS FOR COMPOSITE SIGNAL DECODING

[75] Inventor: Randall C. Restle, Crestview Hills, Ky.

[73] Assignee: Texas Instruments Incorporated, Dallas, Tex.

[21] Appl. No.: 739,130

[22] Filed: Jul. 30, 1991

[51] Int. Cl.[5] ..... H04H 5/00

[52] U.S. Cl. ..... 381/7; 331/25; 375/97; 375/113; 329/324; 329/361

[58] Field of Search ..... 381/7; 331/25; 329/323, 329/324, 361; 375/97, 113

[56] References Cited

U.S. PATENT DOCUMENTS 4,577,334 3/1986 Boer et al. ..... 375/97
4,723,288 2/1988 Borth et al. ..... 381/329
4,757,538 7/1988 Zink ..... 381/7
4,827,515 5/1989 Reich ..... 381/7
5,166,641 11/1992 Davis et al. ..... 331/25

*Primary Examiner*—Forester W. Isen
*Attorney, Agent, or Firm*—J. P. Violette; Robby T. Holland; Richard Donaldson

[57] ABSTRACT

Generally, and in one form of the invention, a composite signal decoder (60) is disclosed which does not require synchronizing the sampling rate to the phase of the incoming pilot signal. Curve fitting filter (126) upsamples and interpolates the incoming composite signal (A) using a bank of coefficient filters selected from filter coefficient bank storage (122) by Bank Selector (124). Bank selector (124) operates in response to a phase offset value produced by phase calculator (112). Because curve fitting filter (126) need not be synchronous with the incoming pilot signal, the output sample rate can be asynchronous from the input sample rate. Other devices, systems and methods are also disclosed.

18 Claims, 11 Drawing Sheets

$Y_{\emptyset} = C_0 \times D_1 + C_1 \times I_1 + C_2 \times I_0 + C_3 \times D_0 + C_4 \times I_{15} + C_5 \times I_{14} + \cdots$

DEVICES, SYSTEMS, AND METHODS FOR COMPOSITE SIGNAL DECODING

FIELD OF THE INVENTION

This invention generally relates to devices, systems and methods for decoding a composite signal.

BACKGROUND OF THE INVENTION

Without limiting the scope of the invention, its background is described in connection with a scheme for demodulating a composite frequency modulation (FM) stereo signal, as an example.

A composite FM stereo signal is of the form:

$$fm(t)=[l(t)+r(t)]++Ap\sin(\omega_p t)+[l(t)-r(t)]\sin(2\omega_p t) \quad \text{EQ'N 1}$$

where:

fm(t) is the time varying value of the composite signal;
l(t) is the time varying value of the left channel signal;
r(t) is the time varying value of the right channel signal;
$A_p$ is the amplitude of the 19 KHz pilot signal;
$\varpi_p$ is the pilot frequency of $2\pi$*19 K radians per second (19 KHz).

FIG. 1 illustrates a frequency spectrum of a typical FM stereo composite signal showing the components of Equation 1. The components include a sum of the left and right channel signals covering a 15 KHz bandwidth from DC to 15 KHz and the difference of the left and right channels modulated to and centered about 38KHz carrier signal, with a 30 KHz bandwidth. Additionally the signal includes a 19 KHz tone signal, commonly referred to as the pilot signal which is used as a reference signal for the radio receiver. The composite signal may also contain subsidiary signals in the 53 KHz to 75 KHz bandwidth such as subsidiary communication authorization (SCA). These signals are excluded from FIG. 1 for clarity.

The composite signal must be separated into left and right channels in order to reproduce the broadcast message in stereo. This requires extracting from the composite signal the values of the left channel and the right channel signals in isolation from the other components of the composite signal. In one method to achieve this the composite signal is decoded by lowpass filtering the signal to extract the [left(t)+right(t)] component; mixing the [left(t)−right(t)] component from 38 KHz (i.e. $\sin(2\varpi_p t)$) down to DC; and lowpass filtering the result to extract the [left(t)−right(t)] component. These two components are then input to a matrix which performs arithmetic addition and subtraction to extract the decoded left and right channel signals, one method to separate the composite signal is discussed in Shanmugam, Digital and Analog Communication Systems, §6.6 (1979). Such an approach is difficult to implement given the sample rate which is required. Since an FM composite signal has at least a 53 KHz bandwidth, a sample rate of greater than 106 KHz (the Nyquist rate)is necessary. This corresponds to only 9.4 us of processing time for filtering. At this sample rate significant amplitude distortion of the signal will result.

Another method to separate the composite signal is disclosed in U.S. Pat. No. 4,723,288 issued to Borth et al. the decoded left and right channel signals can be extracted directly from the composite signal by sampling the composite signal at particular points relative to the pilot signal. Referring again to Equation 1, note that when the 38 KHz carrier signal [$\sin(2\varpi_p t)$] equals plus or minus one, fm(t) equals 2 times the left channel signal and two time the right channel signal, respectively, plus the 19 KHz pilot signal term which can be subsequently filtered out. Since the carrier signal is suppressed and since it is synchronized and locked to a harmonic of the pilot signal, the pilot signal can be used to determine when the carrier signal is uniquely plus or minus one. These events occur when the phase of the pilot signal is at an odd multiple of 45°. As can be seen from Equation 1, when the pilot signal phase is at 45° and 235°, the value of the composite signal is twice the left signal, and when the pilot signal is at 135° and 315° the value of the composite signal is twice the right signal. In both of these situations the value of composite also contains the component of the pilot signal itself, but this component can easily be filtered out as is well known in the art. When the phase of the pilot signal is detected passing one of these four phase points, the incoming composite signal should be produced.

However, this approach requires that one sample the input signal at very near the exact time that the pilot signal phase is one of the four odd multiple values of 45° as discussed above (corresponding to the carrier signal taking on the value of plus or minus one). If the signal is sampled when the pilot signal phase is off somewhat, the left and right channel recovery is degraded and distortion results. Borth et al. uses a voltage controlled oscillator feedback path to phase lock the sample rate onto the pilot carrier phase and frequency. This approach involves costly and complex hardware for implementation. Additionally, this approach requires the reference frequency of the decoder be a multiple of twice the carrier frequency above 152 KHz.

SUMMARY OF THE INVENTION

Generally, and in one form of the invention, a composite signal decoder is disclosed which does not require synchronizing the sampling rate to the phase of the incoming pilot signal. This is accomplished by upsampling and curve-fitting the incoming composite signal through interpolation filtering in order to calculate what the value of the incoming composite signal was at those times when the pilot signal phase was at one of the desired phase points.

An advantage of the invention is that through curve fitting the incoming signal, it is not necessary to synchronize the sampling rate to the phase or frequency of the reference pilot signal. In this way the cost and expense associated with synchronizing the sampling rate to the phase of the pilot signal is avoided. Additionally, since sampling is independent of pilot signal phase, the sampling rate need not be an integer multiple of the pilot signal frequency, as was previously required.

DETAILED DESCRIPTION OF PREFERRED EMBODIMENTS

Figure 1:
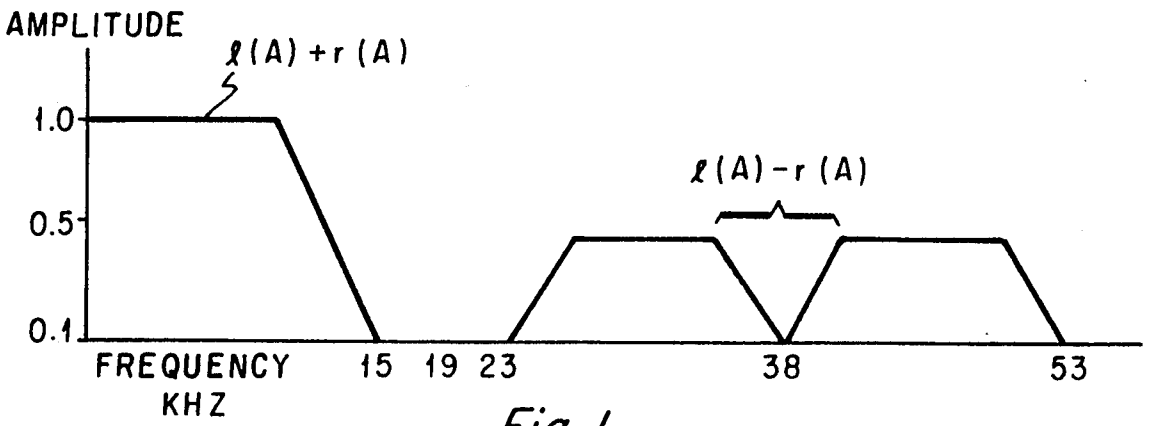
FIG. 1 is a frequency spectrum representation of a typical FM stereo composite signal.
Figure 2:
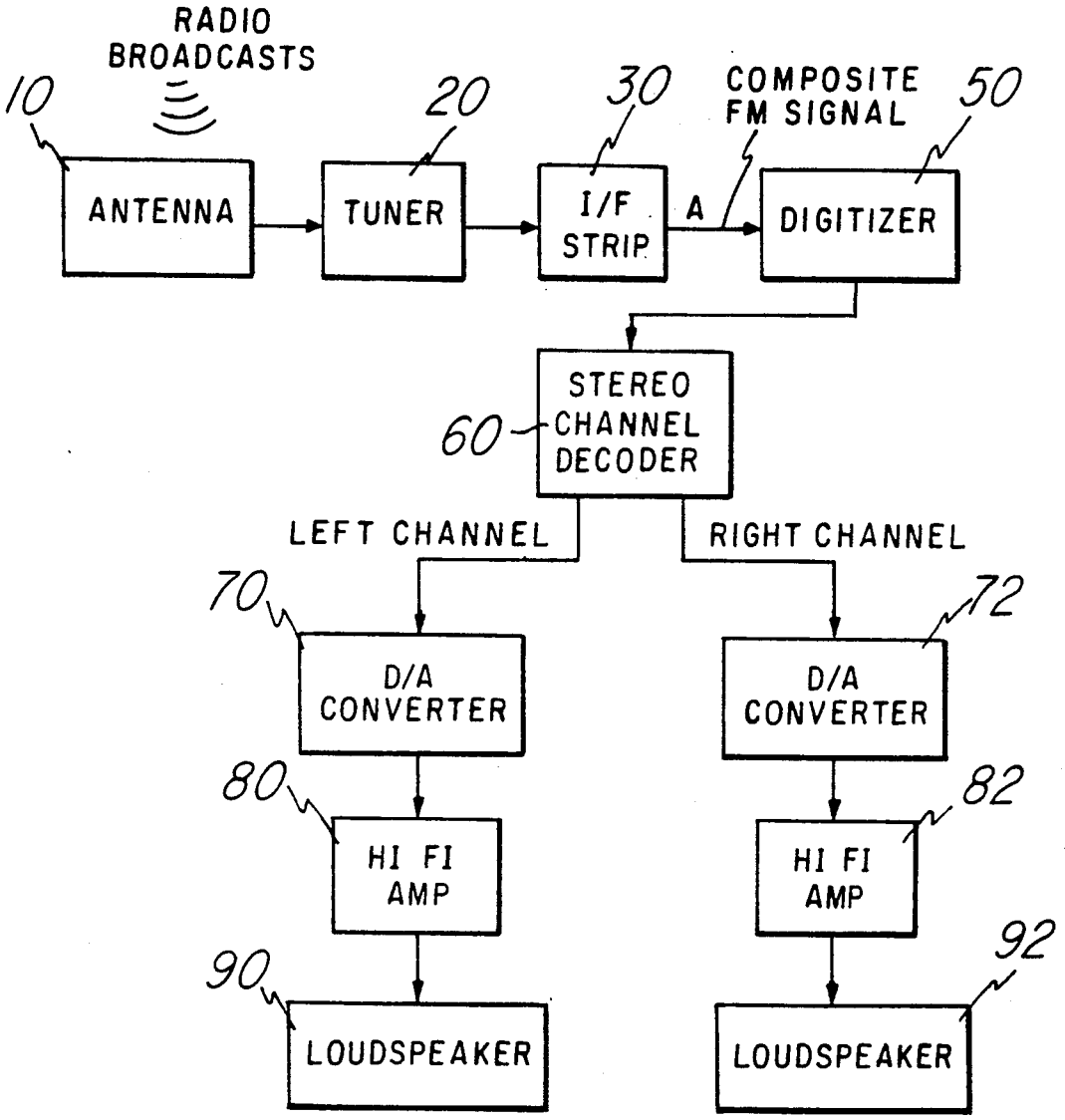
FIG. 2 is a block diagram of a stereophonic radio system.

The present invention is described in accordance with a first preferred embodiment radio receiver system, as shown in FIG. 2. In FIG. 2, antenna 10 receives radio frequency broadcasts, including the composite FM signal which is to be demodulated and decoded. Tuner 20, connected to antenna 10, discriminates which band of frequencies are passed from antenna 10 to Intermediate Frequency (IF) Strip 30 which demodulates the radio frequency (RF) signal down to IF, as is well known in the art. IF Strip 30 conditions and outputs a composite FM signal A which has its frequency spectrum shown in FIG. 1. Composite FM signal A is then fed from IF strip 30 to digitizer 50 which converts composite FM signal A from an analog form to a digital form. The digital form of composite FM signal A is then fed into Stereo Channel Decoder 60 where the individual left and right channel signals are decoded from the composite signal for reproduction of the original stereo acoustics. The individual left and right channel signals produced by Stereo Channel Decoder 60 are fed to D/A converters 70 for the left channel signal and 72 for the right channel signal. D/A converters 70 and 72 are of any well known type of D/A converters to one skilled in the art. As is also well known in the art, the output of D/A converters 70 and 72 are smoothed and fed to high-fidelity amplifiers 80 and 82 respectively for signal amplification, and these amplified signals are fed to loudspeakers 90 and 92 respectively where the electrical signals are converted to acoustical signals.

Figure 3:
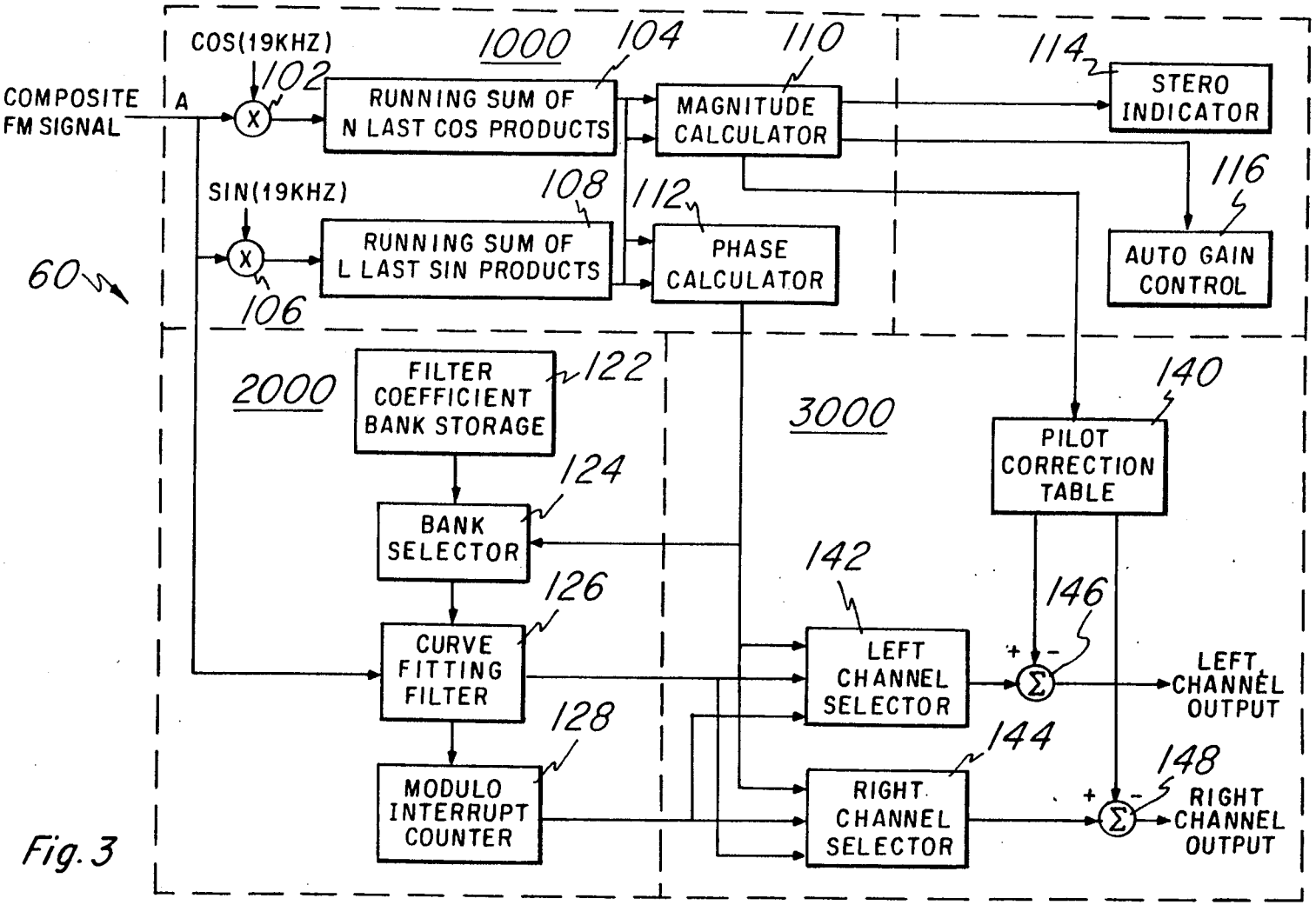
FIG. 3 is a block diagram of a composite signal decoder.

FIG. 3 illustrates stereo channel decoder block 60 in greater detail. In the first preferred embodiment, Stereo Decoder Block 60 could be realized using a Digital Signal Processor (DSP) such as a Texas Instruments TMS320C25 chip. Stereo Channel Decoder Block 60 contains sections 1000, 2000, and 3000. Incoming composite signal A, the frequency spectrum of which is illustrated in FIG. 1 is mixed in block 102 with an internally generated 19 KHz cosine wave signal, to provide the in-phase value of the 19 KHz pilot signal component of the composite FM signal A. Similarly composite FM signal A is mixed with an internally generated 19 KHz sine wave signal in block 106, resulting in the quadrature value of the pilot signal. Blocks 104 and 108 keep a running sum of the last N values of the in-phase and quadrature signals output from blocks 102 and 106, respectively in order to minimize the noise associated with "leakage" of the FM signal below 15 KHz and above 23 KHz. In a preferred embodiment, N is chosen as 128 samples to cancel out a satisfactory level of leakage noise from the in-phase and quadrature values. Alternatively, the in-phase and quadrature signals from blocks 102 and 106 could be passed through a low-pass filter with a frequency cutoff below 4 KHz in order to filter out the noise components of the signals.

In FIG. 3 magnitude calculator 110 calculates the magnitude of the pilot signal from the in-phase and quadrature values output by blocks 104 and 108. Magnitude calculation is well known in the art and can be accomplished by, for instance, taking the square root of the sum of the squares for each of the in-phase and quadrature signals. The output of magnitude calculator 110 serves several functions. The output of magnitude calculator 110 is compared to a predetermined threshold level to determine whether the radio is receiving a stereo broadcast. If the magnitude of the pilot signal exceeds the threshold level, indicating a stereo broadcast is being received, stereo indicator 114 is actuated. Additionally the output of magnitude calculator block 110 serves as a reference level for automatic gain control block 116. Automatic gain control block 116 is of a type well known in the art, and generally varies the gain of signal amplification as a function of the amplitude of some component of the received signal—in this embodiment the pilot signal amplitude. Furthermore, the output of magnitude calculator 110 drives pilot correction table 140, as is explained below in reference to section 3000.

In FIG. 3, phase calculator 112 is also fed by the in-phase and quadrature values output by blocks 104 and 108. In a first preferred embodiment, phase calculator 112 calculates the phase offset between the internally generated 19 KHz reference signal and the pilot signal by Taylor Series expansion of the arc tangent function using the ratio of in-phase to quadrature values. The output of phase calculator 112 drives an input of bank selector 124, and curve fitting filter 126 in section 2000, and left and right channel selectors 142 and 144, respectively, in section 3000.

Still referring to FIG. 3, section 2000 includes filter coefficient bank storage block 122 which can be realized in a read-only-memory (ROM) or random-access-memory (RAM) depending upon constraints in cost and flexibility requirements. Block 122 contains several banks of filter coefficients which can be input to curve fitting filter 126, through bank selector 124. Bank selector 124 selects a bank of filter coefficients in response to phase offset value output from phase calculator 112. The selected bank of filter coefficients is fed to curve fitting filter 126, which advantageously performs an interpolation and curve-fitting process on incoming composite FM signal A, as described below. Section 2000 also includes modulo interrupt counter 128 which connects the output of curve fitting filter 126 to left channel selector 142 and right channel selector 144 each time a data point of the incoming signal is sampled. In section 3000 of FIG. 3, the output of curve fitting filter 126 is input to left and right channel selectors 142 and 144, respectively. Also input to the channel selectors is the output from modulo interrupt counter 128. Depending on the value output from modulo interrupt counter 128 (relating to the amount of pilot signal and reference signal offset) either left channel selector 142 or right channel selector 144 actively receives the signal from curve fitting filter 126 and phases it to left channel summer 146 or right channel summer 148, respectively. Based on magnitude of the pilot signal output by magnitude calculator 110, pilot correction table 140 outputs a correction signal sufficient to offset or remove the pilot signal. This correction signal is mixed with the left channel signal in summer 146, and with the right channel signal in summer 148. The left channel and right channel signals are then in condition to be output and amplified.

In FIG. 3, curve fitting filter 126 advantageously includes an interpolation filter which up-samples the incoming signal in order to increase the effective sampling rate and interpolates data points between the sampled data points in order to eliminate the need to synchronize the sampling rate to the pilot signal. Interpolation is accomplished in curve fitting filter 126 by padding the input signal with equally spaced zero values and then lowpass filtering the signal. In a first preferred embodiment an interpolation factor of 3:1 is used. The input signal is padded with two equally spaced zeroes between each data sample. This padded signal is then digitally filtered using one of the banks of filter coefficients in bank storage 122 selected by bank selector 124. The result after filtering is an output signal that corresponds to the input signal, but with three data points for every non-zero data point input to the filter, and with an attenuation factor of three. This output is obtained because the filtering process forces the incoming zero value data samples to conform to the values required to fit the curve defined by the non-zero data samples.

Figure 4:
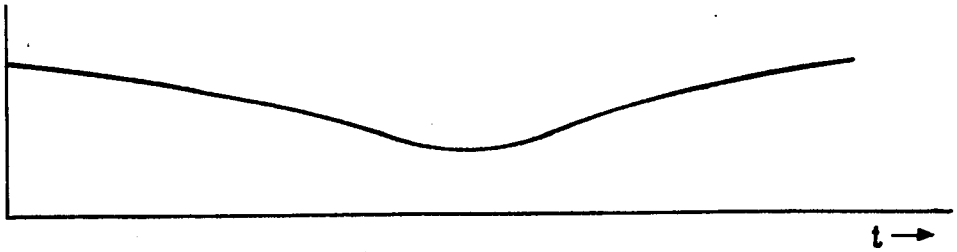
FIGS. 4–7*a* are graphical representations in both time and frequency domain of an analog input signal, being digitally sampled and interpolated by a digital filter, FIGS. 4, 5, 6, and 7 being in time domain, FIGS. 4*a*, 5*a*, 6*a*, and 7*a* being in frequency domain.
Figure 4A:
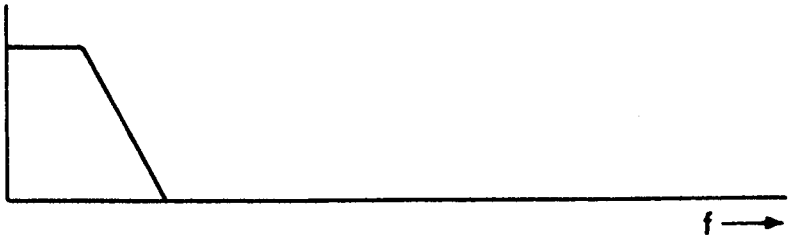
Figure 5:
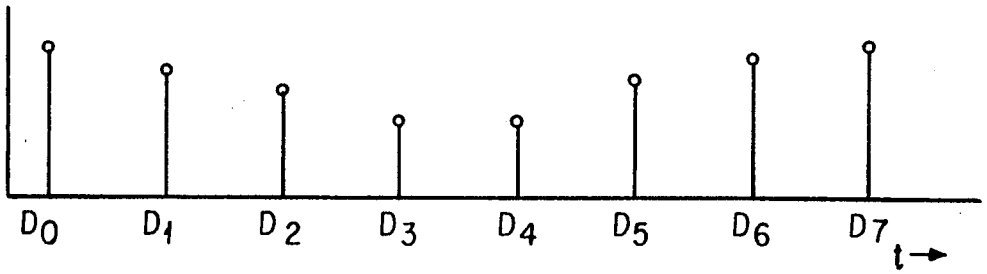
Figure 5A:
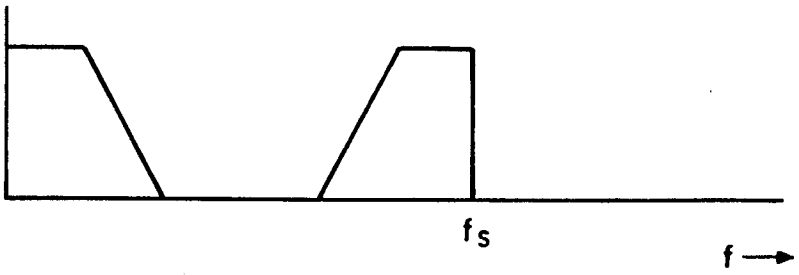
Figure 6:
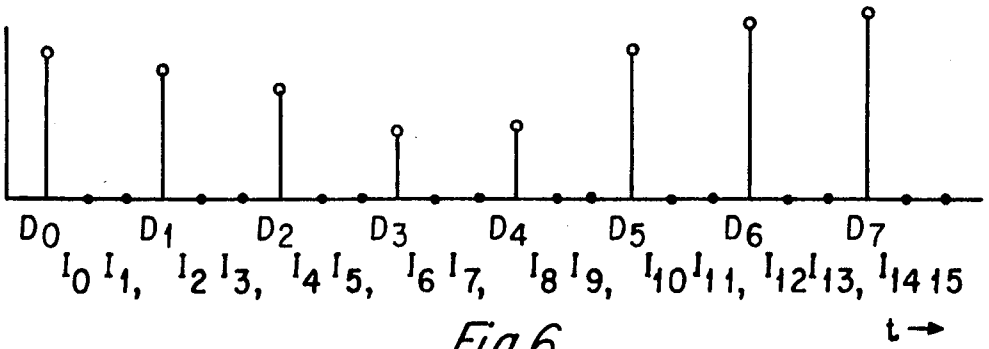
Figure 6A:
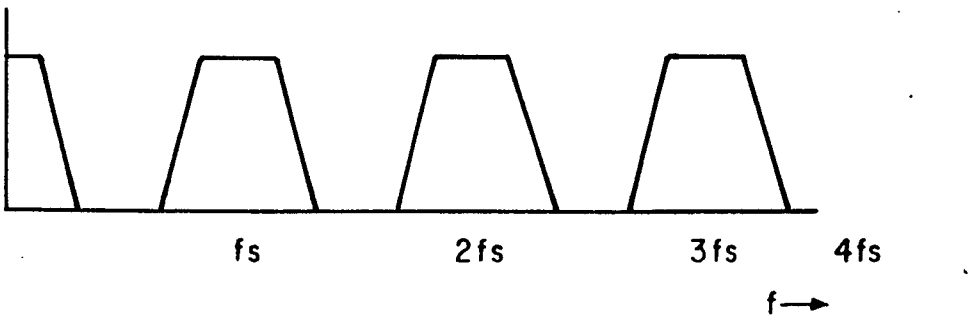

The steps of up-sampling and curve-filtering as performed by curve fitting filter 126 of FIG. 3 can be more readily understood with reference to FIGS. 4–7*a*. FIGS. 4, 5, 6, and 7 depict the time domain while FIGS. 4*a*, 5*a*, 6*a*, and 7*a* depict the frequency domain. FIGS. 4*a* illustrate an idealized portion of incoming composite signal A input to curve fitting filter 126, and digitally up-sampled and interpolated by the 3:1 interpolation filter. FIGS. 5 and 5*a* illustrates the resulting digital signal corresponding to digitally sampling the signal of FIGS. 4 and 4*a*. The digital signal of FIGS. 5 and 5*a* is next padded with two zero data points between each input data sample in order to produce a 3:1 interpolation factor, as illustrated in FIGS. 6 and 6*a*. After low pass filtering, the signal resembles that illustrated in FIGS. 7 and 7*a*. Note that the zero value input points have been forced through the curve fitting process of the filter to assume the value they must have in order to fit the curve defined by the non-zero input values. Note also that the output signal has a sample frequency three times that of the input, and has also been attenuated by a factor of three. This is due to an energy averaging function of the filter.

In FIG. 3, phase calculator 112, curve fitting filter 126, bank selector 124, and bank storage 122 advantageously operate to allow for the incoming signal to be sampled without synchronizing to the pilot signal. They further operate to all the incoming signal to be interpolated in order to determine what the value of the incoming signal must have been at that time when the pilot signal phase was at one of the desired points, i.e. an odd multiple of 45°. Advantageously they also allow the system to operate without requiring the output sample rate of curve fitting filter 126 to be asynchronous to the input sample rate.

Figure 7:
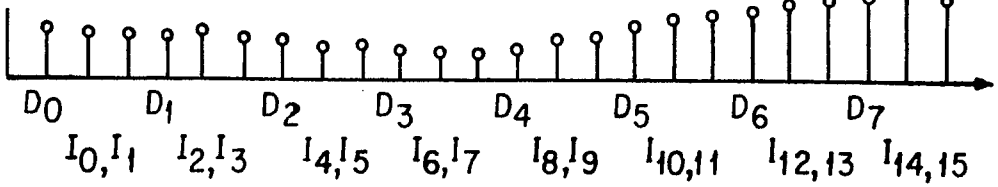
Figure 7A:
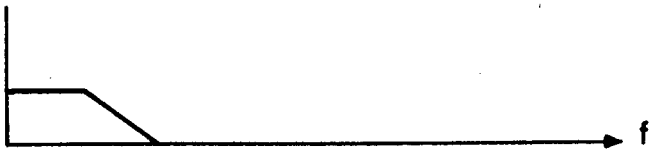
Figure 8:
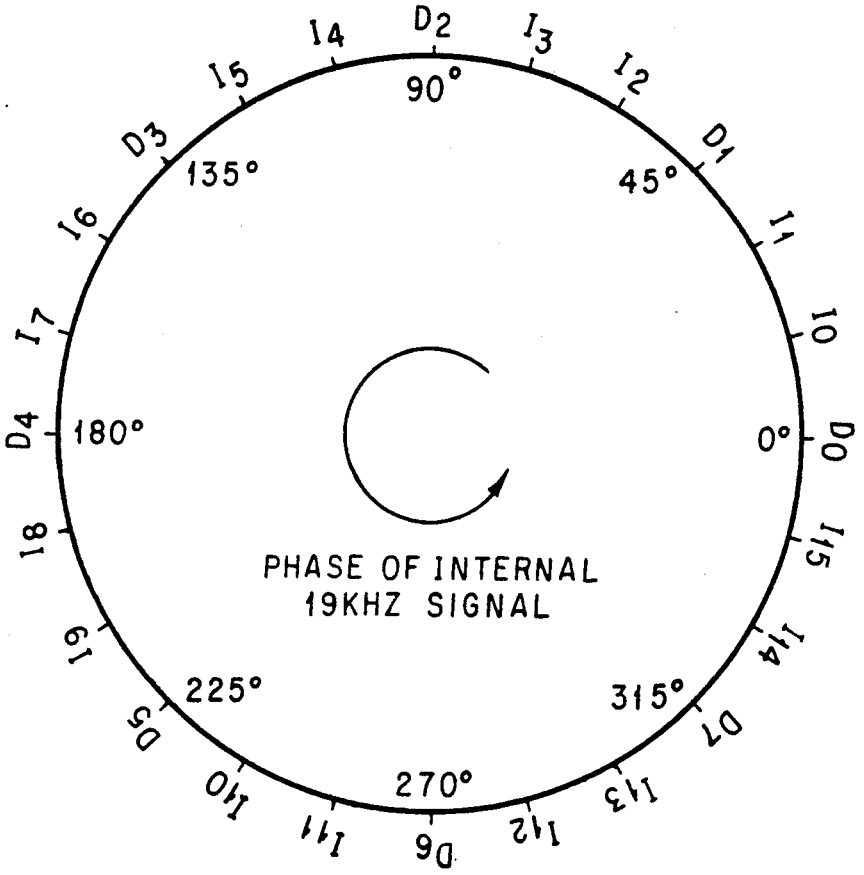
FIG. 8 is a phasor diagram of an internally generated reference signal showing the phase points at which data points are sampled and interpolated.

FIG. 8 illustrates a phasor diagram of the internally generated 19 KHz reference sine wave reference signal. Curve fitting filter 126 has a 152 KHz sampling rate, meaning the block will sample the incoming composite signal eight times during each cycle of the 19 KHz signal. The incoming signal will be sampled when the reference 19 KHz signal's phase is at 0°, 45°, 90°, 135°, 180°, 225°, 270°, and 315° as shown in FIG. 8 as points $D_0$, $D_1$, $D_2$, $D_3$, etc. These points on the phasor diagram correspond to incoming signal data samples $D_0$, $D_1$, $D_2$, $D_3$, etc. of FIGS. 4–7*a*. In other words, data sample $D_0$ is sampled when the reference signal's phase is at 0°; data sample $D_1$ is sampled when the reference signal's phase is at 45°, etc. If the reference 19 KHz signal and the incoming 19 KHz pilot signal were perfectly in phase then sampling the incoming signal when the reference 19 KHz signal was at 45°, 135°, 225°, and 315° would correspond to the same phase for the pilot signal. In such a situation no further processing would be required. However, in most situations, the pilot signal and the reference signal are not perfectly in phase. The sampled signal may be interpolated to determine what the value of the incoming signal was when the pilot signal was in fact an odd multiple of 45°. For instance, if the phases of the reference signal and pilot signal were offset by 15° the data point sampled at the 45° point $D_0$ of the reference signal would correspond to the 30° phase of the reference pilot signal. In order to determine what the incoming signal value was at the 45° phase point of the pilot signal, the value of the incoming signal corresponding to the 60° phase point of the reference signal $I_2$ must be determined. This can be accomplished through interpolation.

Phase calculator 112 provides a value by which to determine what phase points on the reference signal of FIG. 7 corresponds to the multiples of 45° phase points of the pilot signal. In the first preferred embodiment of a 3:1 interpolation factor, phase calculator 112 can output one of 24 values. The phase calculator outputs one of 24 values corresponding to an offset between the pilot and reference of between 0° and 360°. 24 modulo 8 determines which curve fitting filter bank should be used to produce an interpolated value of the incoming signal. Note that 24 minus 24 modulo 8 specifies how many 45° multiples the pilot and reference signals are offset. This is used to determine when it's appropriate to produce an output (e.g.: the left or right channel value). If the pilot signal and the reference signal are approximately in phase, phase calculator 112 will output an offset value of 0, 3, 6, etc. If the two signals are not in phase, phase calculator 112 will output an offset value of 1, 4, 7, etc. if the offset is approximately 15° or an offset value of 2, 5, 8, etc. if the offset is approximately 30°. Greater accuracy and less signal distortion results by choosing a higher factor of interpolation. Typically the interpolation factor for acceptable levels of signal distortion will be greater than three, as will be discussed below in reference to a second preferred embodiment.

Figure 9:
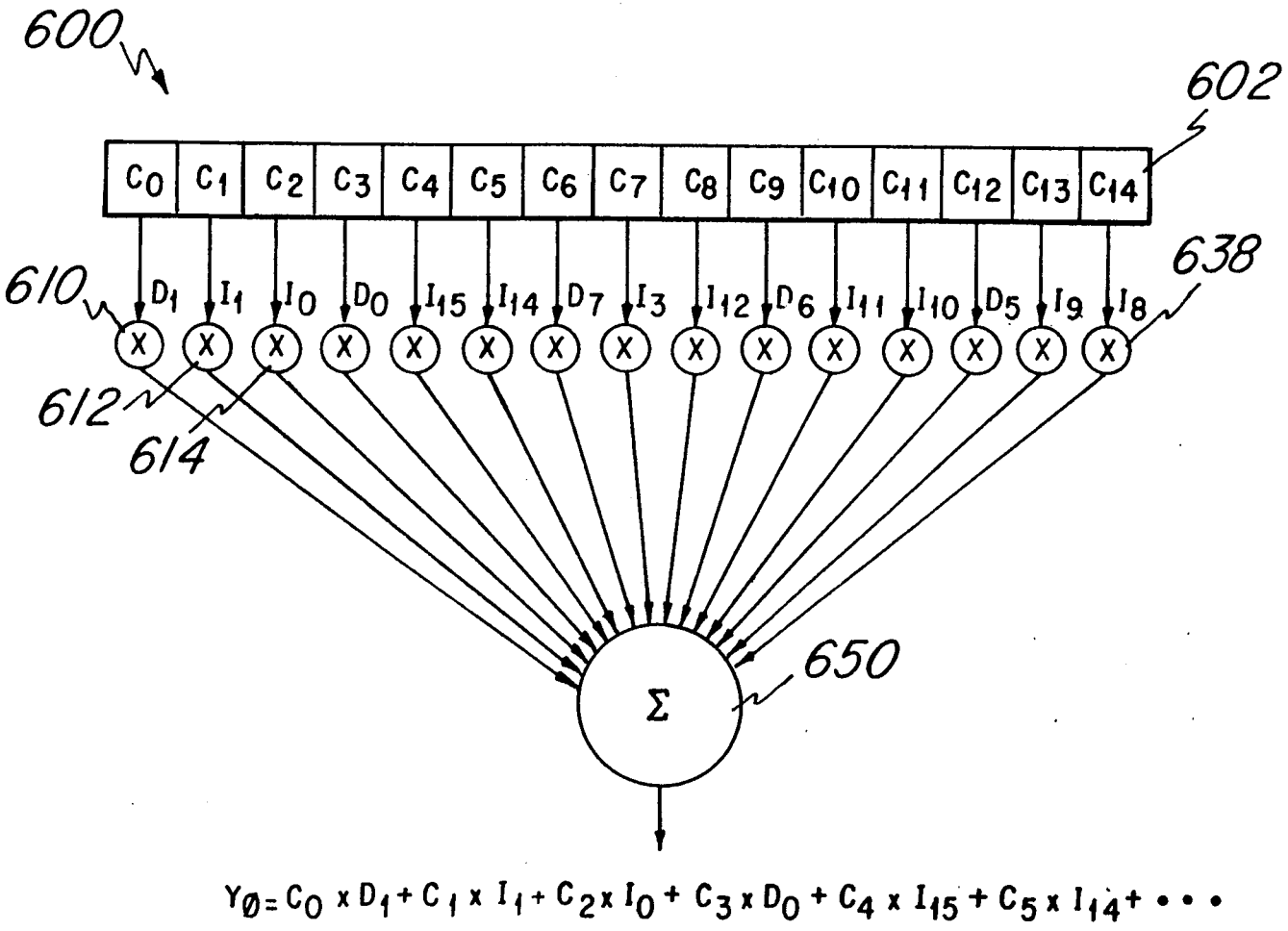
FIGS. 9-9*b* are schematic representations of a digital filter.
Figure 9A:
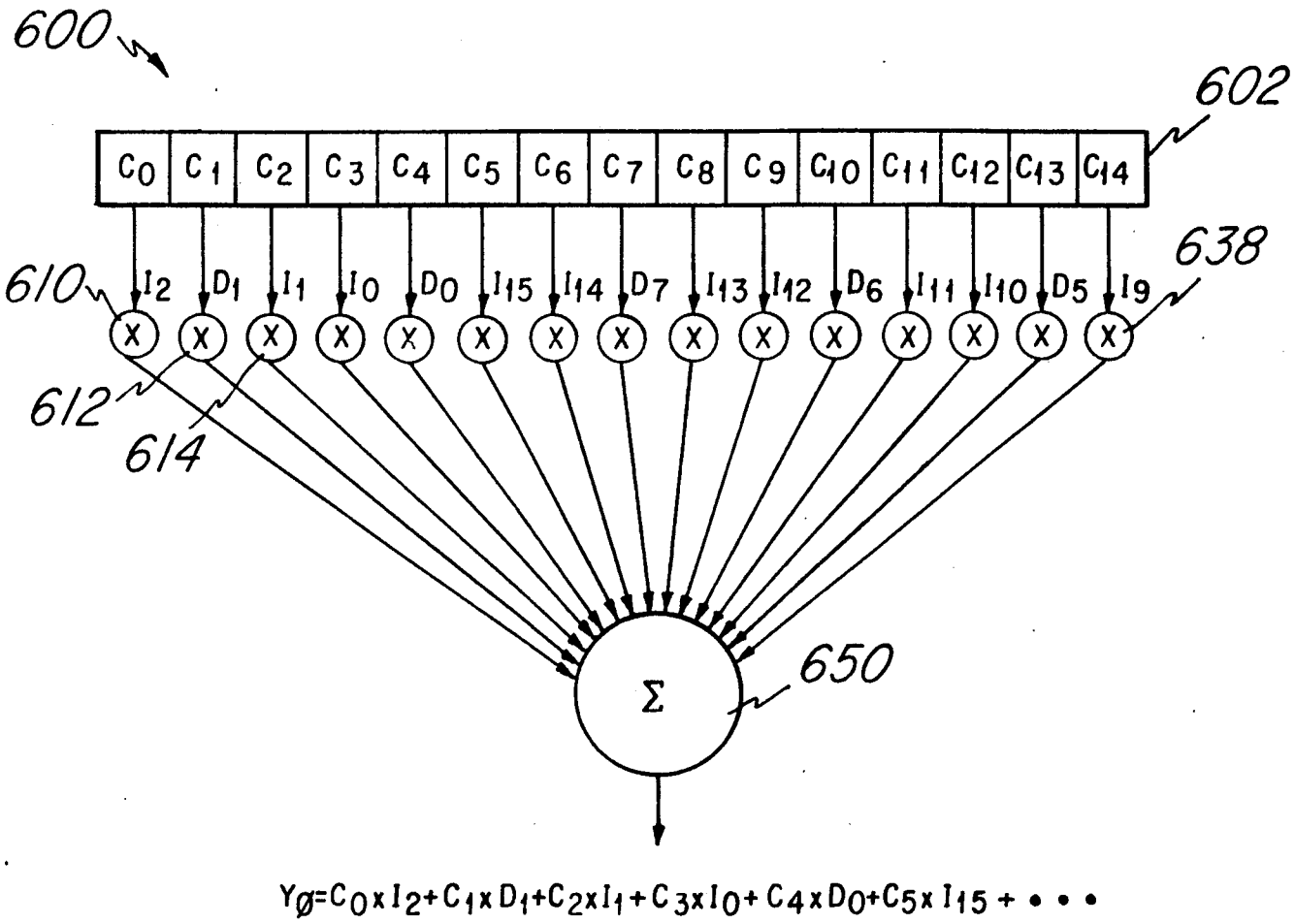
Figure 9B:
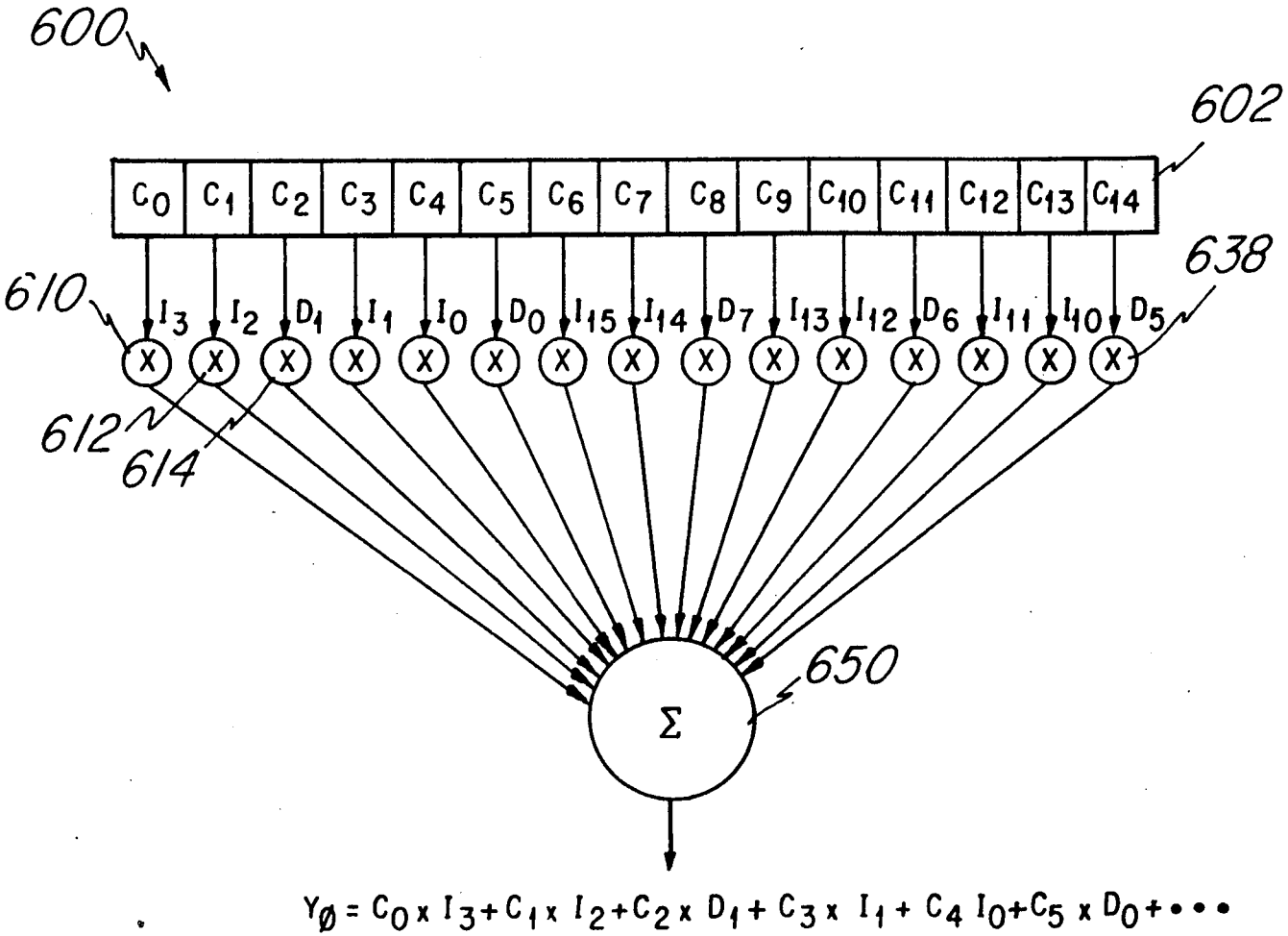

In FIG. 9 the padded input signal of FIG. 6 is input to interpolation filter 600 of curve fitting filter 126 when the offset value of phase calculator 112 is 0. Filter 600 is a finite input response (FIR) filter with fifteen taps and which consists of filter coefficient bank 602, multipliers 610–638, and summer 650. The padded signal of FIG. 6 is input to filter 600 and each data point is multiplied in multipliers 610–638 with a corresponding filter coefficient. The products of multipliers 610–638 are summed in summer 650, resulting in the output value $Y_0$ as shown. FIG. 9*a* illustrates filter 600 when the phase offset value of phase calculator 112 is 1, and FIG. 9*b* illustrates the filter when the offset value is 2. As discussed above, FIG. 9 corresponds to the situation where the pilot signal and reference signal are in phase. In such a situation the output value of the filter will equal the input value. In FIG. 9*a*, however, the two signals are not in phase and the output of the filter is that value which the incoming signal must have been at a point 15° offset from the 45° (or 135° or 225° or 315°) data sample, corresponding to a 15° offset between the pilot signal and the reference signal. This corresponds to determining the value of the incoming signal at point $X_0$ in FIG. 8 based on the values of the known points $D_1-D_7$. Similarly FIG. 9*b* 6*c* corresponds to the situation where the pilot and reference signals are offset by 30° and the output of the filter is that value the incoming signal must have had at a point on the signal when the reference signal was 30° off from the 45° point. This corresponds to determining the value of the incoming signal at point $X_1$ in FIG. 8 based on the values of the known points $D_1$–$D_7$.

Filter 600 can be divided into 3 separate banks of filter coefficients by eliminating those coefficients which are multiplied by a zero value for each of the three scenarios illustrated in FIG. 6. Bank zero, rather than including all fifteen coefficients $C_0$–$C_{14}$, would include only coefficients $C_0$, $C_3$, $C_6$, $C_9$, and $C_{12}$ corresponding to those coefficients in FIG. 9 which are multiplied by a nonzero value input. Similarly, Bank one would include only coefficients $C_1$, $C_4$, $C_7$, $C_{10}$, and $C_{13}$ corresponding to those coefficients of FIG. 9*a* which are multiplied by a nonzero value input. Similarly, Bank two would include coefficients $C_2$, $C_4$, $C_8$, $C_{11}$ and $C_{14}$. These banks of coefficients are stored in filter coefficient bank storage 122 and the appropriate bank to be used by curve fitting filter 126 is selected by bank selector 124 depending on the offset value output by phase calculator 112. In this way, rather than an output from the filter requiring fifteen multiplication and additions steps, each output only requires five steps. Hence the processing time to interpolate the incoming signal is greatly reduced.

In a second preferred embodiment, stereo channel decoder 60 of FIG. 3 uses an interpolation factor of 7:1 to derive sufficient accuracy in the interpolation process to minimize cross-channel noise to 30 dB. Setting the left channel signal component of Equation one to 0 and the right channel signal component to 1, gives the following equation:

$$fm(t)=R(t)[1-\mathrm{SIN}(2\bar{\omega}_p)t)+\Phi] \qquad \text{EQ'N 2}$$

In order for this value to be −30 dB when recovering the left channel at $2\bar{\omega}_p t=90°$ requires:

$$10^{-\frac{30}{20}} = 1 - \mathrm{SIN}(90° + \phi) \qquad \text{EQ'N 3}$$

Equation 3 is solved for $\phi$, giving the result of $\phi=14.5°$ of accuracy required for 30 dB of channel separation. 14.5° results in 1.055 us of processing time for a 38 KHz signal (the FM carrier frequency) by the equation:

$$\frac{14.5°}{360°} \times \frac{1}{38\mathrm{KHz}} = 1.05\ \mu s \qquad \text{EQ'N 4}$$

1.055 us of processing time corresponds to a frequency of 947.5 KHz. In order to have an effective frequency of 947.5 KHz from a sampling frequency of 152 KHz requires a 6.2:1 interpolation factor. The physical constraints of the interpolation filter require an integer factor, hence the value of 7:1 for the preferred embodiment interpolation filter. Using a 7:1 interpolation factor also requires greater accuracy of the phase calculator. In the second preferred embodiment, the phase calculator is operable to calculate an offset value of within 6.4°, resulting in offset values between zero and six. This increased resolution allows for the 45° phase point of the pilot signal to be calculated with much greater precision.

The interpolation filter of the second preferred embodiment requires 112 taps. The second preferred embodiment uses a 12-bit digitizer. In order to produce a 12-bit accurate curve fitted data point, a finite impulse response (FIR) digital filter is required having a passband ripple of less than 1 part in 4096 and a stopband attenuation of 4095. Further, for curve fitting the signal of FIG. 1, the filter requires a zero (DC) to 53 KHz passband and a transition band between 53 KHz and 99 KHz. For 7:1 interpolation, the sample rate to use when designing the interpolation filter must be seven times the actual (i.e.: non-interpolated) sample rate. 99 KHz stopband edge is required to eliminate aliasing of the 2nd spectral copy of FIG. 1 as shown in FIG. 5 which is centered at 152 KHz. Additionally, since only one seventh of the filter coefficients (taps) line up with nonzero input points, the filter coefficients are scaled up by a factor of seven to compensate.

Additionally, the second preferred embodiment takes advantage that although eight sample points are input for every cycle of the 19 KHz pilot signal, only four of the eight inputs (corresponding to the odd multiples of 45°) are output to the left and right channel selectors. Because of this the interpolation filter process can be divided into two separate halves. In other words, when an even multiple of 45° (e.g.: 90°, 100°, 270°, 360°, etc. data point is input to the 112 tap filter no processing is required of the filter as no data will be output. This would result in the filter performing no processing during the even phase point inputs and performing 14 multiplication and addition steps during the odd phase point. Instead, in the second preferred embodiment, advantage is taken of the even phase point input times to perform half of the 14 multiplication and addition steps required for the odd phase points. When the odd phase point is subsequently input the remaining multiplication and addition steps can be performed and an output value produced.

In summary, the present invention, as illustrated by the preferred embodiments provides an apparatus and method to decode a composite signal comprising an information signal and a pilot signal, wherein the information signal can be extracted by sampling the composite signal at points corresponding to pre-determined phase angles of the pilot signal by calculating the phase angle offset of the pilot signal and a reference signal and using this offset value to determine which interpolated data point derived from the composite signal corresponds to the value of the composite signal at the predetermined phase angles.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An apparatus for decoding a composite signal, the composite signal comprising an information signal and a pilot signal, wherein said information signal is decoded by determining the amplitude of said composite signal at pre-determined phase angles of said pilot signal, the apparatus comprising:

a signal generator configured to generate a reference signal;

a phase calculator input with said reference signal and said composite signal and outputting a value corresponding to the phase offset between said reference signal and said pilot signal;

a bank selector connected to said phase calculator operable to select one bank of filter coefficients from among a plurality of banks of filter coefficients in response to said phase offset value and to load said selected bank of filter coefficients into a curve fitting filter; wherein said curve fitting filter samples said composite signal and decodes said information signal by calculating the amplitude of said composite signal corresponding to said specific phase angles of the pilot signal, whereby said information signal is decoded without the need to synchronize to the phase of said pilot signal.

2. The apparatus of claim 1 wherein said composite signal is of the form, $$fm(t)=[l(t)+r(t)]+Ap\sin(\omega_p t)+[l(t)-r(t)]\sin(2\omega_p t)$$

and wherein the information signal comprises l(t) and r(t).

3. The apparatus of claim 1 wherein said apparatus is fabricated as a single integrated circuit.

4. The apparatus of claim 1 wherein said pilot signal is a single frequency, time-invariant signal.

5. The apparatus of claim 1 wherein said composite signal amplitude equals said pilot signal amplitude and an integer multiple of said information signal amplitude at said predetermined phase angles.

6. The apparatus of claim 1 wherein said pre-determined phase angles consist of odd multiples of forty-five degrees (45°).

7. A radio receiving system, capable of decoding left and right channel signal components from a composite stereo signal, the composite stereo signal including a pilot signal component, the system comprising:

an antenna for receiving stereo radio broadcasts;

a tuner connected to said antenna for discriminating a frequency band from among said broadcasts;

a demodulator connected to said tuner for demodulating said frequency band from radio frequency to intermediate frequency;

a decoder connected to said demodulator for extracting individual channels of stereo composite signal, comprising:

a signal generator configured to generate a reference signal;

a phase calculator with inputs fed by said reference signal and said composite stereo signal and outputting a value corresponding to a phase offset between said pilot signal and said reference signal;

an analog to digital converter connected to, the phase calculator for sampling data points of said composite stereo signal;

an interpolator for calculating additional data points of said composite stereo signal;

a selector for selecting and outputting one of said data points or said additional data points in response to said phase offset value;

an amplifier connected to the output of said decoder for amplifying a signal output from said decoder; and speakers connected to said amplifier to convert said amplified signal to an acoustic signal.

8. The system of claim 7 further comprising a magnitude calculator with inputs fed by said reference signal and said composite stereo signal and outputting a value corresponding to the magnitude of said pilot signal.

9. The system of claim 7 further comprising channel selector means connected to said selector and said phase calculator, configured to connect said selector's output to said amplifier.

10. The apparatus of claim 7 wherein said radio broadcasts comprise frequency modulation (FM) stereo broadcasts.

11. The system of claim 7 wherein said interpolator and selector are realized as a curve-fitting filter and further comprising a bank selector connected to said curve-fitting filter and said phase calculator and configured to input a bank of filter coefficients to said curve-fitting filter in response to said phase offset value.

12. The system of claim 11 wherein said curve-fitting filter interpolates by a factor of 7:1 and comprises a 112 tap lowpass filter.

13. A method for extracting an information signal from a composite signal comprising said information signal and an additional signal wherein said information signal is sought to be extracted at predetermined phase angles of said additional signal, comprising the steps of:

generating a reference signal of substantially the same frequency as said additional signal;

calculating a phase offset value between said additional signal and said reference signal;

sampling data samples of said composite signals when said reference signal is at pre-determined phase angles; and calculating, from said data samples, values said composite signal had when said reference signal phase angle was offset value from said pre-determined phase angle by said phase offset, whereby said calculated values of said composite signal correspond to values of said information signal sought to be extracted.

14. The method of claim 13 wherein said pre-determined phase angles consist of odd multiples of forty-five degrees (45°).

15. The method of claim 13 wherein said second calculating step comprises:

interpolating said data samples to produce additional data samples; and selecting an additional data sample based on said phase offset between said additional signal and said reference signal.

16. The method of claim 13 wherein said composite signal is of the form $$fm(t)=[l(t)+r(t)]+Ap\sin(\omega_p t)+[l(t)-r(t)]\sin(2\omega_p t).$$

17. The method of claim 16 wherein said additional signal comprises a 19 Khz pilot signal.

18. The method of claim 16 wherein said information signal comprises a left channel signal and a right channel signal.

* * * * *